United States Patent [19]

Blackman

[11] Patent Number: 4,628,556

[45] Date of Patent: Dec. 16, 1986

[54] TILT-PREVENTION MECHANISM FOR ADJUSTABLE BED

[75] Inventor: Lionel H. Blackman, West Palm Beach, Fla.

[73] Assignee: Daniel J. Blackman, West Palm Beach, Fla. ; a part interest

[21] Appl. No.: 609,003

[22] Filed: May 10, 1984

[51] Int. Cl.[4] ..... A47C 21/08; A47C 21/00; A61G 7/00

[52] U.S. Cl. ..... 5/424; 248/550; 5/62; 5/63; 5/66; 5/508

[58] Field of Search ..... 5/60–66, 5/424, 508; 297/330; 248/550

[56] References Cited

U.S. PATENT DOCUMENTS

| | | | |
|---|---|---|---|
| 2,880,720 | 4/1959 | Houghtaling | 5/62 |
| 3,220,019 | 11/1965 | Nelson | 5/62 |
| 3,371,358 | 3/1968 | Shackel | 5/108 |
| 3,373,453 | 3/1968 | Goodman | 5/63 |
| 3,462,772 | 8/1969 | Morrison | 5/63 |
| 3,611,453 | 10/1971 | Lokken | 5/62 |
| 3,694,830 | 10/1972 | Koller | 5/63 |
| 3,972,081 | 8/1976 | Stern et al. | 5/68 |
| 4,227,269 | 10/1980 | Johnston | 5/66 |
| 4,324,010 | 4/1982 | Houlberg et al. | 5/68 |
| 4,325,061 | 4/1982 | Wolar | 5/424 |
| 4,403,214 | 9/1983 | Wolar | 5/424 |
| 4,407,030 | 10/1983 | Elliott | 5/424 |
| 4,425,673 | 1/1984 | Werner | 5/63 |
| 4,463,463 | 8/1984 | Kaneko | 5/424 |

*Primary Examiner*—Gary L. Smith
*Assistant Examiner*—Michael F. Trettel
*Attorney, Agent, or Firm*—Kirschstein, Kirschstein, Ottinger & Israel

[57] ABSTRACT

A tilt-preventing mechanism for a height-adjustable bed of the type including a mattress which is supported in a substantially horizontal position on a support structure which can be moved up and down by means of an electric motor. When the mattress, or its support structure, encounters during its up or down movement an obstruction which causes one region of the mattress to discontinue its movement while other regions continue to move with attendant tilting of the mattress, a position-sensitive switch arrangement of the mechanism senses the tilting and, once the degree of tilt approaches or reaches the limit of acceptable tilting, inactivates the motor so that the tilting is not aggravated any more. The position-sensitive switch arrangement includes one or two switches arranged normal to the expected axis or axes of tilting and moving with the support structure. The position-sensitive switches can be constructed as mercury switches.

9 Claims, 4 Drawing Figures

TILT-PREVENTION MECHANISM FOR ADJUSTABLE BED

BACKGROUND OF THE INVENTION

The present invention relates to adjustable beds in general and, more particularly, to a tilt-prevention mechanism for use in adjustable beds of the type used in hospitals.

Various constructions of adjustable and/or tiltable beds and similar equipment are already known, for instance, from the U.S. Pat. Nos. 3,220,019; 3,371,358; 3,373,453; 3,462,772; 3,611,453; 3,694,830; 3,972,081 and 4,324,010. In many instances, the mattress of an adjustable hospital bed can be adjusted not only as to its elevation from the ground, but also as to its shape, i.e. it can be contoured to afford comfort to, or aid in the recovery of, the patient occupying the bed. The positional adjustment is usually achieved by means of an electric motor and a transmission arrangement which converts the rotation of the output shaft of the motor into displacement of the desired portions of the bed.

Experience with the adjustable beds of the conventional constructions has shown that, as advantageous as they may be in various respects, they all suffer from a serious drawback which resides in the fact that, when an external obstruction hampers the displacement of the mattress and/or its movable support structure at any region thereof, the remainder of the mattress and its support structure continues its movement unimpeded, so that the mattress begins to tilt, typically toward one of the sides of the bed, and continues tilting unless the operation of the motor is discontinued by the patient or an attendant or nurse, until the degree of the lateral tilt is such that the patient may be thrown against a raised side guard rail of the bed, or if the guard rail is lowered, the patient may be caused to fall off the bed. This, of course, is highly undesirable, since it can result in injury to the patient, aggravation of an already existing condition, or disconnection of various life-support apparatus with attendant grave consequences. Of course, this possibility could be avoided if the attendants or nurses were paying attention not only to the operation of the bed, but also to the presence of possible obstructions in the path of movement of the adjustable part of the hospital bed. Unfortunately, this cannot always be assured, so that it occasionally happens that the mattress of an adjustable bed moves into its undesirable tilted position, and the patient is at least inconvenienced, if not injured.

SUMMARY OF THE INVENTION

Accordingly, it is a general object of the present invention to avoid the disadvantages of the prior art.

More particularly, it is an object of the present invention to provide a tilt-prevention mechanism for an adjustable bed, particularly a hospital bed, which does not possess the disadvantages of the conventional beds of this type.

Still another object of the present invention is to provide a height-adjustable bed with a mechanism for avoiding undesirable tilting of the bed during the raising and/or the lowering thereof.

It is yet another object of the present invention so to design the mechanism of the above type as to be simple in construction, inexpensive to manufacture, easy to use and install in existing hospital beds, and reliable in operation nevertheless.

A concomitant object of the present invention is to develop a mechanism for use on the bed of the above type which would restrict the extent of tilting of the bed to an acceptable degree, and discontinue the movement of the bed once this degree is reached.

In pursuance of these objects and others which will become apparent hereafter, one feature of the present invention resides in a tilt-prevention mechanism for use in an adjustable bed, especially for use in hospitals and similar institutions for bedridden patient care, the bed comprising a mattress extending along a predetermined plane at least when a patient resting thereon is to assume a prostrate position; a support for the mattress; means for maintaining the support at an adjustable distance above ground in a plurality of positions in which the predetermined plane extends substantially horizontally, with freedom of movement of the support substantially normal to the predetermined plane, and at least limited freedom of tilting about at least one axis that is parallel to the predetermined plane, with attendant deviation of the predetermined plane from the horizontal; and means for moving the support substantially normal to the predetermined plane between the aforementioned positions with the possibility of tilting of the support about the aforementioned axis upon application of external forces thereto at least during the operation of the moving means, the moving means including a motor and means for energizing the motor when adjustment of the distance is desired. The tilt-prevention mechanism itself advantageously comprises means for sensing the magnitude of the deviation and for inactivating the energizing means when the magnitude exceeds a predetermined value.

An advantage of the mechanism as described so far is that the sensing and inactivating means discontinues the operation of the moving means, so that the degree of tilt cannot exceed a predetermined value which is well within the acceptable range, that is, within the range in which the patient is only mildly inconvenienced by the tilt, but in which no danger of patient's shifting or rolling under the influence solely of gravitational forces exists.

According to an advantageous aspect of the present invention, the motor is constructed as an electric motor; the energizing means includes a source of electric energy, and an electric circuit connected to the source and having the electric motor interposed therein. Then, the sensing and inactivating means of the mechanism advantageously includes position-sensitive switching means incorporated in the electric circuit between the source and the electric motor and mounted on the support for movement therewith. This results in a particularly simple and otherwise advantageous construction since the operation of the electric motor can be easily controlled, for instance, by a high-voltage switch which is, in turn, included in the aforementioned circuit that is operated at relatively low voltage under these circumstances.

Advantageously, the switching means includes at least one mercury switch that extends substantially normal to the aforementioned axis and substantially parallel to the predetermined plane. However, when the maintaining means also gives the support freedom of tilting about another axis substantially normal to the aforementioned axis, the switching means includes at least two position-sensitive switches each sensitive to the tilting of the support about a different one of the aforementioned two axes. Then, at least one of such switches is a mercury switch extending substantially normal to one of the axes and substantially parallel to the predetermined plane. However, it is also advantageous when the other of the switches is also a mercury switch extending substantially normal to the other of the axes and also substantially parallel to the predetermined plane. It is particularly advantageous, especially as far as the simplicity of the arrangement is concerned, when the switches are arranged in the electric circuit in series with one another and with the electric motor.

The novel features which are considered as characteristic of the invention are set forth in particular in the appended claims. The improved tilt-prevention mechanism itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
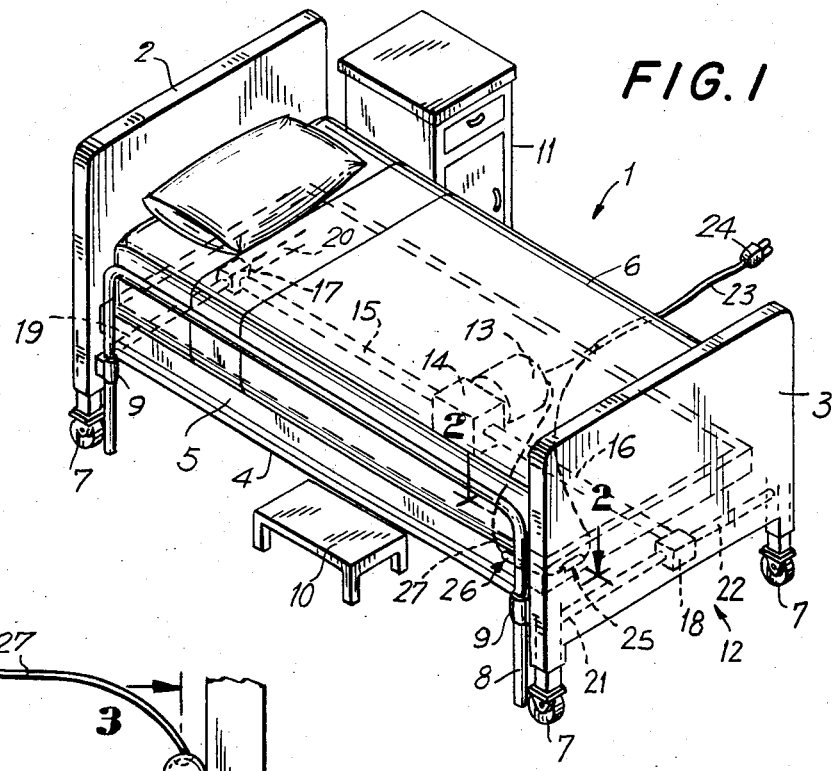
FIG. 1 is a perspective view of a hospital bed embodying the present invention, and its environment.

Referring now to the drawing in detail, and first to FIG. 1 thereof, it may be seen that the reference numeral 1 has been used therein to identify a hospital bed constructed in accordance with the present invention, in its entirety. The bed 1 comprises, as its main components, a headboard 2, a footboard 3, a frame 4 which interconnects the headboard 2 with the footboard 3 to constitute a support therewith, a boxspring 5 which is supported on the frame 4, and a mattress 6 which rests on the boxspring 5. However, it will be appreciated that, if desired, the boxspring 5 could be omitted and then the mattress 6 would rest directly on the frame 4 and/or on planks or spring mesh spanning the opening of the frame 4, as usual. Also, instead of or in addition to the frame 4, one could use a substantially plate-shaped support structure of, for instance, plyboard or particle board or the like, to support either the boxspring 5 or the mattress 6 thereon. Both the headboard 2 and the footboard 3 are shown to be supported on respective casters, as also well known, to give the bed 1 mobility over the floor on which it is supported.

Optionally, and as also shown in FIG. 1, the bed 1 can be equipped, at least on one of its lateral portions, with a guard rail 8 which is shown to be mounted on the headboard 2 and on the footboard 3 by means of respective brackets 9. If desired, the brackets 9 can be so constructed, in accordance with well known principles, that the guard rail 8 can be moved relative to the headboard 2 and the footboard 3 in the vertical direction, to adjust the extent to which the guard rail 8 extends above the upper plane of the mattress 6. Thus, if need be, the guard rail 8 can be moved towards its upper position in which it confines the patient in the bed 1 against unintentional rolling off the bed 1 during sleep or the like, or towards its lower position to permit the patient to sit on the edge of the bed 1 and, if desired, to rise from the bed 1 and walk away, if the patient's faculties permit this. A stool 10 may be positioned close to the bed 1 to help the patient in this task or to let the patient rest his or her feet thereon when sitting on the edge of the bed 1 with the legs depending downwardly. Also, a nightstand 11 may be arranged next to the bed 1, for use by the patient and/or the nursing staff.

The frame 4 or its equivalent as described above is mounted on the headboard 2 and the footboard 3, or on any construction which interconnects the headboard 2 and the footboard 3 and constitutes a solid base therewith, for movement in the vertical direction, so that the elevation of the mattress 6 above ground can be adjusted as desired. So, for instance, it may be desired to raise the mattress 6 and its supporting structure 4 and 5 when the patient is to be examined in bed 1, or when the nursing staff or attending physician has to perform certain operations involving the patient, such as introduction of intravenous or nasal tubes or other tasks frequently performed in hospitals, to assure unproblematical performance of such tasks in view of their performance at the most advantageous elevation. Moreover, it may be necessary or desirable to displace the mattress 6 to the proper elevation for transfer of the patient to or from a transporting device. On the other hand, it may be desired to lower the mattress 6 for the patient's feet to be able to reach the floor or the stool 10, for instance, so that the patient can walk away from the bed 1. Under some circumstance, it may also be desired to be able to tilt the mattress 6 with its supporting structure 4 and 5 to a certain extent about a longitudinal axis of the bed 1, for example, to help the nurse roll the patient over or for other similar purposes, or about the transverse axis of the bed, to change the elevation of the patient's head relative to that of the feet. These various movements of the mattress 6 may be the only movements which the mattress 6 may be able to perform while supported on the support structure 4 and/or 5, or it may be able to perform other movements as well while so supported; so, for instance, the mattress 6 and its support structure 4 and 5 may be partitioned in various zones in the longitudinal direction of the bed 1, and these sections or zones may be capable of assuming different positions relative to one another, for supporting the patient, for instance, in a comfortable sitting position or the like. Even in this instance, however, the mattress 6 is returnable to its basic position in which it extends along a substantially horizontal plane.

To be able to raise and lower the mattress 6 with its support structure 4 and/or 5, there is provided a moving mechanism indicated generally in FIG. 1 by the reference numeral 12. It will be appreciated that this mechanism 12 may be of any of many currently known and used constructions; yet, an exemplary construction of the mechanism 12 is indicated in the drawing. In this construction, the mechanism 12 includes an electric motor 13 which drives a distributing transmission 14 that is of a conventional construction that need not be discussed here. The transmission 14 drives two output shafts 15 and 16, which may be constituted by sections of a unitary shaft passing through the transmission 14. The output shafts 15 and 16 respectively terminate in auxiliary transmissions 17 and 18 which, in turn, drive respective branch shafts 19, 20, 21 and 22 in rotation.

Here again, the branch shafts 19 and 20, and 21 and 22, may be parts of throughgoing unitary shafts. The branch shafts 19, 20, 21, and 22 may carry, at their free ends, respective gears or pinions which have not been shown in detail in FIG. 1 in order not to unduly encumber the drawing, since they are conventional. These pinions then may mesh with associated racks provided on the headboard 2 and on the footboard 3, respectively. A supply cable 23, which is shown to be equipped with a plug 24 insertible into a wall outlet or a similar electric receptacle, serves to supply electric current to the electric motor 13 to energize the same. The electric motor 13 is preferably of the reversible type to cause forced movement of the frame 4 both in the raising and lowering directions. As usual, the operation of the motor 13 may be accomplished either by plugging the plug 24 into the outlet, or by operating a switch which, as usual, may be provided in the supply cable 23 or at any location between the source of electric energy and the motor 13. It will be understood that the construction of the mechanism 12 as described above has been chosen for the purpose of illustration alone, and that other constructions of the mechanism 12 could be used as well in the bed 1 constructed according to the present invention, so long as they employ a motor which can be conveniently and quickly energized and de-energized. Of course, the electric motor 13 is particularly suited for the purposes of the present invention and for the contemplated use; yet, other motors, such as hydraulic or pneumatic motors could be used as well, if sources of the respective energizing media are readily available.

Now, as mentioned before, it could happen that the mattress 6, or its supporting structure 4 and/or 5, could be interfered with during its travel in the upward or downward direction, at only a limited region thereof. Thus, it could occur that further movement of this region is rendered impossible, for instance, by interference with the nightstand 11, the stool 10, or any other objects or equipment located close to the bed 1, while the remainder of the mattress 6 and its supporting structure 4 and/or 5 continues to move. This, obviously, would result in tilting of the mattress 6, about either the longitudinal axis, or the transverse axis, of the support structure 5 and/or 6, provided that the mechanism 12 permits such tilting movement, as it usually does. The tilting about the longitudinal axis would be the more dangerous of the two, since it could easily and rapidly result in such a degree of tilt that the patient would be caused to roll off the bed and fall on the floor, with attendant danger of injury either as a result of the fall itself, or of the disconnection of the patient from lifesupport equipment, or of the catapulting of the patient against a raised guard rail.

Figure 2:
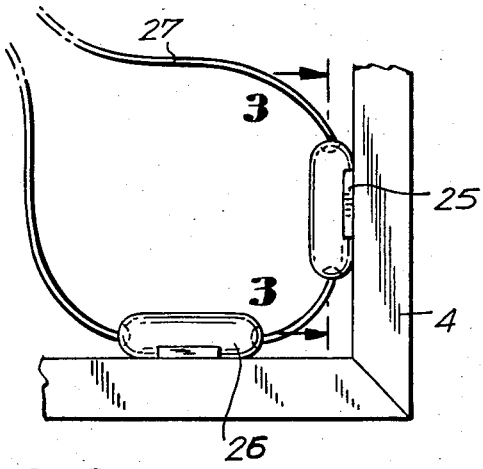
FIG. 2 is a top plan view of a fragmentary detail of a frame of the bed of the present invention, taken along the plane 2—2 of FIG. 1.

To avoid this possibility, the bed 1 according to the tilt-prevention mechanism of the present invention is provided with at least one position-sensitive switch 25 or, as illustrated, also with an additional position-sensitive switch 26. The switch 25 and/or the switch 26 is inserted in an electric line 27 (see particularly FIG. 2) which connects one conductor of the cable 23 with the electric motor 13. The switch 25 is shown to be arranged on the frame 4 so that its longitudinal axis extends along the plane of the frame 4 and thus the plane of the mattress 6 and transversely of the bed 1; that is, substantially normal to the longitudinal axis of possible tilting of the mattress 6 with its supporting structure 4 and/or 5. The switch 26, on the other hand, extends in the longitudinal direction of the bed 1 and, hence, normal to the other, transverse axis of possible tilting, and also parallel to the plane of the mattress 6.

Figure 3:
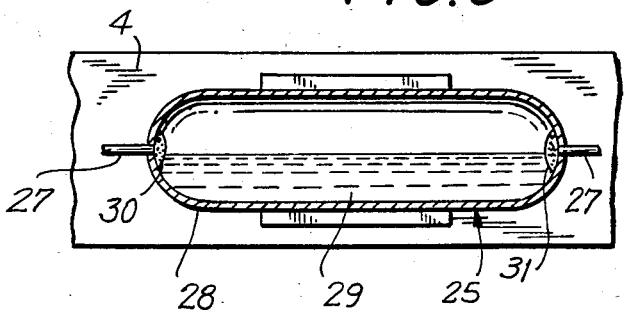
FIG. 3 is a somewhat enlarged longitudinal sectional view through a mercury switch used in the arrangement of the present invention, taken along the line 3—3 of FIG. 2, and with the frame in a desired horizontal position.
Figure 4:
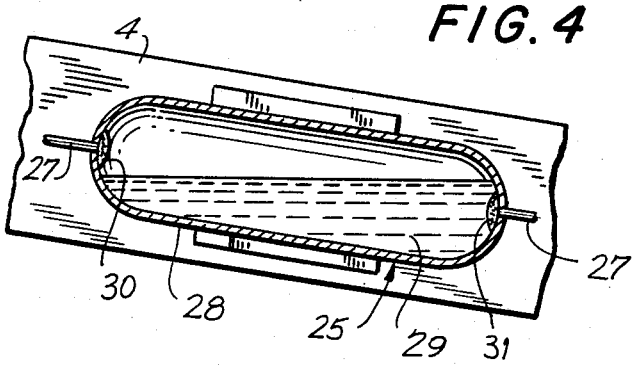
FIG. 4 is a view similar to that of FIG. 3 but with the frame in an undesirably tilted position.

As shown in FIGS. 3 and 4, the switch 25 and, similarly, also the switch 26, may be constructed as a mercury switch which is interposed between two sections of the circuit line 27 and which includes an enclosed envelope 28 partially filled with a body 29 of mercury. So long as the section of the frame 4 on which the switch 25 or 26 is mounted extends substantially horizontally, as it does during the normal operation of the mechanism 12, as well as when the mechanism 12 is out of operation, the upper level of the mercury body 29 assumes the position shown in FIG. 3, in which it establishes an electric current path between respective terminations 30 and 31 of the sections of the line 27. This, of course, means that electric current would be able to flow through the switches 25 and 26 and the line 27, and the electric motor 13 will be capable of being energized or, if already energized, will continue to be energized.

On the other hand, should a portion of the mattress 6 or of its supporting structure 4 and/or 5 be retarded or stopped in its vertical movement, while other portions of the same continue such movement, the respective portion of the frame 4 will be gradually tilted until it reaches its position illustrated in FIG. 4. When this happens, the switch 25 or 26 mounted on this portion of the frame 4 for movement therewith will assume its position of FIG. 4 in which the mercury body 29 is out of contact with the termination 30 (or, if the tilt is in the opposite direction, with the termination 31). This means that the path for the electric current flow through the switch 25 or 26 is interrupted and the electric motor 13 is de-energized or inactivated. Hence, no further movement of the mattress 6 and its supporting structure 4 and/or 5 can occur, and the mattress 6 will remain in its slightly tilted position until the condition which has caused the mattress 6 to tilt is remedied.

It may be seen that the switches 25 and 26 are arranged in series with one another, so that the flow of electric current through the line 27 is interrupted, regardless of whether the tilting takes place about the longitudinal axis of the bed 1, the transverse axis of the bed 1, or both. Of course, the shown construction of the switches 25 and 26 as mercury switches, while currently preferred, is exemplary only, and could be replaced by other known constructions of position-sensitive switches, such as those working on the principle of a pendulum, for instance.

The drawing of the present invention shows the switches 25 and 26 to be incorporated in the line 27 which connects one of the conductors of the cable 23 with the electric motor 13. However, it is also conceivable and contemplated by the present invention to include the switches 25 and 26 in a separate control circuit operating at a relatively low voltage which controls the operation of a high-voltage switch that is interposed between the cable 23 and the electric motor 13. This solution has the advantage that it is not necessary to switch the usually high-wattage electric current supplied to the motor 13 for energizing the same, so that the switches 25 and 26 can be built less robustly than otherwise. Also, it is not necessary to take special safety precaution that would otherwise be needed if the high-wattage electric energy were flowing through the line 27, to prevent flow of the high-voltage current into the framework of the bed 1. This solution is particularly advantageous when a switch operating the motor 13 and controlled by a relatively low voltage is incorporated in the high-voltage circuit to begin with, in that only a relatively simple and inexpensive solid-state circuitry need be added at the control input of this switch (e.g. an AND-gate) to achieve the operation of the mechanism 12 only when the main control switch and the switches 25 and 26 are simultaneously closed.

It will be understood that each of the elements described above, or two or more together, may also find a useful application in other types of arrangements differing from the type described above.

While the invention has been illustrated and described as embodied in a tilt-prevention mechanism and in an improved hospital bed, it is not intended to be limited to the details shown, since various modifications and structural changes may be made without departing in any way from the spirit of the present invention. For example, one or more switches of the type identified by numeral 25 may be employed at one or more corners of the bed. Alternatively, one or more switches of the type identified by numeral 26 may be employed at one or more corners of the bed. The tilt-prevention mechanism is easily installed and retro-fitted in existing adjustable beds.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspect of my contribution to the art and, therefore, such adaptations should and are intended to be comprehended within the meaning and range of equivalence of the claims.

What is claimed as new and desired to be protected by Letters Patent is set forth in the appended claims; I claim:

1. An anti-lateral tilt-preventing adjustable bed, especially for use in hospitals and similar institutions for bedridden patient care, comprising:

a mattress having a longitudinal axis that is parallel to and extends along a predetermined plane at least when a patient resting thereon is to assume a prostrate position;

a support for said mattress;

means for maintaining said support at an adjustable distance above ground in a plurality of positions in which said predetermined plane extends substantially horizontally, with freedom of movement of said support substantially normal to said predetermined plane, and at least limited freedom of undesired tilting in either circumferential direction about said longitudinal axis, with attendant angular deviation of said predetermined plane from the horizontal;

means for moving said support substantially normal to said predetermined plane between said positions with the possibility of undesired tilting of said support in either circumferential direction about said longitudinal axis upon application of external forces thereto laterally and radially of said longitudinal axis at least during the operation of said moving means, including a motor and means for energizing said motor when adjustment of said distance is desired; and anti-lateral-tilt means including a level-sensitive switch for sensing the magnitude of said angular deviation when said switch is tilted from the horizontal, and for inactivating said energizing means when said magnitude exceeds a predetermined value selected to prevent the patient from tending to roll in a radial direction off the side of the bed.

2. The tilt-preventing adjustable bed as defined in claim 1, wherein said motor is an electric motor; wherein said energizing means includes a source of electric energy and an electric circuit connected to said source and having said electric motor interposed therein; and wherein said level-sensitive switch is incorporated in said electric circuit between said source and said electric motor and is mounted on said support for movement therewith.

3. A tilt-preventing adjustable bed, especially for use in hospitals and similar institutions for bedridden patient care, comprising:

a mattress extending along a predetermined plane at least when a patient resting thereon is to assume a prostrate position;

a support for said mattress;

means for maintaining said support at an adjustable distance above ground in a plurality of positions in which said predetermined plane extends substantially horizontally, with freedom of movement of said support substantially normal to said predetermined plane, and at least limited freedom of tilting about at least one axis that is parallel to said predetermined plane and above another axis substantially normal to said axis, with attendant deviation of said predetermined plane from the horizontal;

means for moving said support substantially normal to said predetermined plane between said positions with the possibility of tilting of said support about said axis upon application of external forces thereto at least during the operation of said moving means, including an electrical motor and means for energizing said motor when adjustment of said distance is desired, said energizing means including a source of electric energy and an electric circuit connected to said source and having said electric motor interposed therein; and anti-tilt means for sensing the magnitude of said deviation and for inactivating said energizing means when said magnitude exceeds a predetermined value, said sensing and inactivating means including position-sensitive switching means incorporated in said electric circuit between said source and said electric motor and mounted on said support for movement therewith, said switching means including at least two position-sensitive switches each sensitive to the tilting of said support about a different one of said axes.

4. The tilt-preventing adjustable bed as defined in claim 3, wherein at least one of said switches is a mercury switch extending substantially normal to one of said axes and substantially parallel to said predetermined plane.

5. The tilt-preventing adjustable bed as defined in claim 4, wherein the other of said switches is also a mercury switch extending substantially normal to the other of said axes and substantially parallel to said predetermined plane.

6. The tilt-preventing adjustable bed as defined in claim 3, wherein said switches are arranged in said electric circuit in series with one another and with said electric motor.

7. An anti-lateral tilt-preventing mechanism for an adjustable bed of the type including a mattress extending along a longitudinal axis, and a drive for adjusting the elevation of said mattress, said mattress being undesirably angularly tiltable in either circumferential direction about said longitudinal axis upon application of external forces laterally and radially of said longitudinal axis to said mattress, said mechanism comprising:

means including a level-sensitive switch for sensing the magnitude of the undesirable angular tilt about said longitudinal axis; and means for inactivating said drive when said switch is tilted and when said magnitude of undesirable angular tilt exceeds a predetermined value selected to prevent a person resting on the mattress from tending to roll in a radial direction off the side of the bed.

8. The mechanism as defined in claim 7, wherein said level-sensitive switch is a position-sensitive switch operatively connected to said drive.

9. An anti-lateral tilt-preventing adjustable bed, especially for use in hospitals and similar institutions for bedridden patient care, comprising:

a mattress having a longitudinal axis that is parallel to and extends along a predetermined plane at least when a patient resting thereon is to assume a prostrate position;

a support for said mattress;

means for maintaining said support at an adjustable distance above ground in a plurality of positions in which said predetermined plane extends substantially horizontally, with freedom of movement of said support substantially normal to said predetermined plane, and at least limited freedom of undesired tilting in either circumferential direction about said longitudinal axis, with attendant angular deviation of said predetermined plane from the horizontal;

means for moving said support substantially normal to said predetermined plane between said positions with the possibility of undesired tilting of said support in either circumferential direction about said longitudinal axis upon application of external forces thereto laterally and radially of said longitudinal axis at least during the operating of said moving means, including an electric motor and means for energizing said motor when adjustment of said distance is desired, said energizing means including a source of electric energy and an electric circuit connected to said source and having said electric motor interposed therein; and anti-lateral-tilt means for sensing the magnitude of said angular deviation from the horizontal and for inactivating said energizing means when said magnitude exceeds a predetermined value selected to prevent the patient from tending to roll in a radial direction off the side of the bed, said sensing and inactivating means including position-sensitive switching means incorporated in said electric circuit between said source and said electric motor and mounted on said support for movement therewith, said switching means including at least one mercury switch extending substantially normal to said axis and substantially parallel to said predetermined plane.

* * * * *